US005287719A

United States Patent [19]

Moritaka et al.

[11] Patent Number: 5,287,719

[45] Date of Patent: Feb. 22, 1994

[54] METHOD OF FORMING SEMI-SOLIDIFIED METAL COMPOSITION

[75] Inventors: Mitsuru Moritaka; Sadahiko Shinya; Katsuhiro Takebayashi; Seiro Yahata; Chisato Yoshida, all of Chiba, Japan

[73] Assignee: Rheo-Technology, Ltd., Japan

[21] Appl. No.: 929,782

[22] Filed: Aug. 13, 1992

[30] Foreign Application Priority Data

Aug. 22, 1991 [JP] Japan ..... 3-233821

[51] Int. Cl.[5] ..... B21J 5/02

[52] U.S. Cl. ..... 72/364; 164/900

[58] Field of Search ..... 72/342.8, 364, 377; 164/900

[56] References Cited

U.S. PATENT DOCUMENTS 4,548,253 10/1985 Funatani et al. ..... 164/900
4,687,042 8/1987 Young ..... 164/900
4,771,818 9/1988 Kenney .

FOREIGN PATENT DOCUMENTS 60-152358 8/1985 Japan .
8706957 11/1987 PCT Int'l Appl. .
2112676 7/1983 United Kingdom .

*Primary Examiner*—Lowell A. Larson
*Attorney, Agent, or Firm*—Austin R. Miller

[57] ABSTRACT

When a semi-solidified metal composition is formed in a forging die assembly, it is formed under conditions satisfying particular mass fraction solid and flowing rate in the die and then held under a given pressure until the metal composition is completely solidified.

6 Claims, 14 Drawing Sheets

METHOD OF FORMING SEMI-SOLIDIFIED METAL COMPOSITION

BACKGROUND OF THE INVENTION

1. Field of the Invention

This invention relates to a method of forming a metal material in a die assembly, and more particularly to a die-forging of a semi-solidified metal composition as a starting material at a solid-liquid coexistent temperature region.

2. Description of the Related Art

In general, there are various methods of forming a metal material, among which a forming method such as press forming or the like is widely used for the formation of structural parts. In press forming, the metal material has hitherto been shaped at a temperature below solids, but such a method has several problems cracking is apt to be caused when forming complicated parts or hardly workable parts, a large working load is required, plural forming steps are required, and the like. In order to provide the parts of a given shape, it may be obliged to adopt another method such as forging or the like even if the properties of the resulting part are poor.

As a countermeasure for solving the above problems, there has been developed a method wherein the material is formed at such a state that the material temperature is approximately equal to the die temperature under particular working conditions, or a so-called isothermal forging method. This isothermal forging method can reduce the mechanical working cost for finishing into a final shape when forming a hardly workable material and also effectively contributes to decreasing the working load and the like.

However, the isothermal forging method requires precise control over working rate, so that it has a problem that the equipment for conducting this method becomes too large.

In order to solve the aforementioned problems and widen the range of materials to be formed, a method of working metal in a temperature region between solids and liquids or a solid-liquid coexistent temperature region has recently been studied in various fields. As an example of this method, a method wherein the metal is agitated at the solid-liquid coexistent temperature region by a mechanical means or the like to form non-dendritic structure or a granular structure and solidified at once to form a working material and then the working material is again heated to the solid-liquid coexistent temperature region for forming is disclosed in U.S. Pat. No. 4,771,818.

In general, the method of working the metal at the solid-liquid coexistent temperature region is advantageous for forming hardly workable material, complicated parts or the like because the fluidity of the metal material is good and the force required for the working is small.

However, the above working method has a problem which has never been observed in the conventional techniques.

That is, since the metal is formed at the solid-liquid coexistent temperature region, when the metal material is filled in a die assembly at the forming step, solid phase and liquid phase flow ununiformly and hence the ununiform distribution of solid phase and liquid phase or macrosegregation is caused in a section of the resulting formed product at the completion of the forming. As such a segregation is caused, the structure of the product section becomes ununiform and hence the mechanical properties of the product are ununiform, which are harmful in practical use.

SUMMARY OF THE INVENTION

It is, therefore, an object of the invention to advantageously solve the above problems and to provide an advantageous method of forming semi-solidified metal compositions which can maintain a good dispersion state of solid phase at the completion of the forming even in complicated parts and does not cause the macrosegregation and hence ununiform structure in the section of the product.

According to the invention, there is the provision of, in a method of forming a semi-solidified metal composition by die-forging a semi-solidified metal composition as a starting material at a solid-liquid coexistent state, the improvement wherein said starting material is formed under conditions that a mass fraction solid of said starting material at the time of starting said forging is 0.2–0.8 and the flowing rate of said starting material in a filling region of a die assembly is not less than 3.5 m/sec and is then held under a pressure of not less than 6 kg/mm$^2$ until said starting material is completely solidified after the die assembly is filled.

DESCRIPTION OF THE PREFERRED EMBODIMENTS

The invention will be described in detail below.

At the solid-liquid coexistent temperature region, the state of the starting material such as fraction solid or the like susceptibly changes to a slight change of temperature. In this connection, the inventors have made die-forging experiments using a vertical type hydraulic press by varying fraction solid of a starting material within a wide range.

Figure 1:
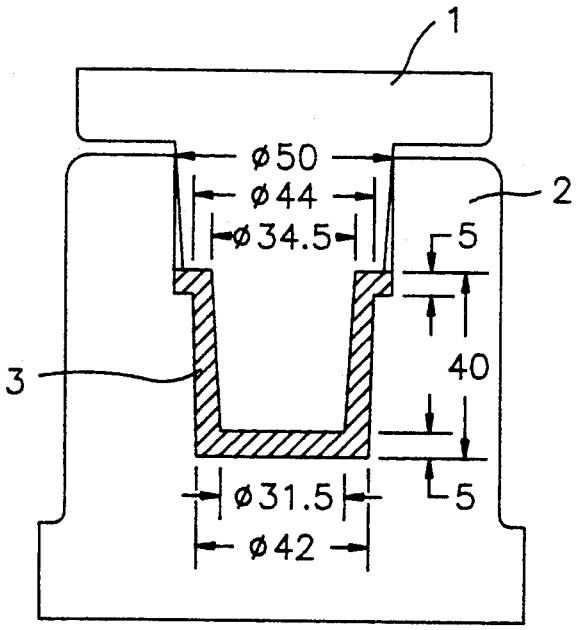
FIG. 1 is a diagrammatical view of a usual die assembly.

A starting material of Al–4.5 wt% Cu alloy is agitated at the solid-liquid coexistent temperature region by a mechanical means and solidified by cooling to room temperature, from which a specimen of 36 mm in diameter and 30 mm in height is cut out and then heated to a temperature range corresponding to a mass fraction solid (fs) of the starting material at the solid-liquid coexistent temperature region of 0.95–0.2 and formed in the die assembly shown in FIG. 1. In this case, the starting material is heated in the die assembly to equalize the temperature of the starting material in the forming to the die temperature, whereby the decrease of temperature due to the contact with the die assembly is prevented in order to exactly examine the behaviors of solid phase and liquid phase at the forming step as far as possible. Moreover, the forging velocity (ram velocity) is 40 mm/sec. In FIG. 1, numeral 1 is an upper die, numeral 2 a lower die and numeral 3 a forged product.

In order to quantitatively grasp the behaviors of solid phase and liquid phase in the resulting cup-shaped product, the distribution of Cu concentration at positions in the section of the product is measured by means of an X-ray microanalysis. As the amount of liquid phase at the completion of the forming becomes large, the Cu concentration is high, so that the degree of segregation in the section of the product can be known from the distribution of Cu concentration.

Figure 2:
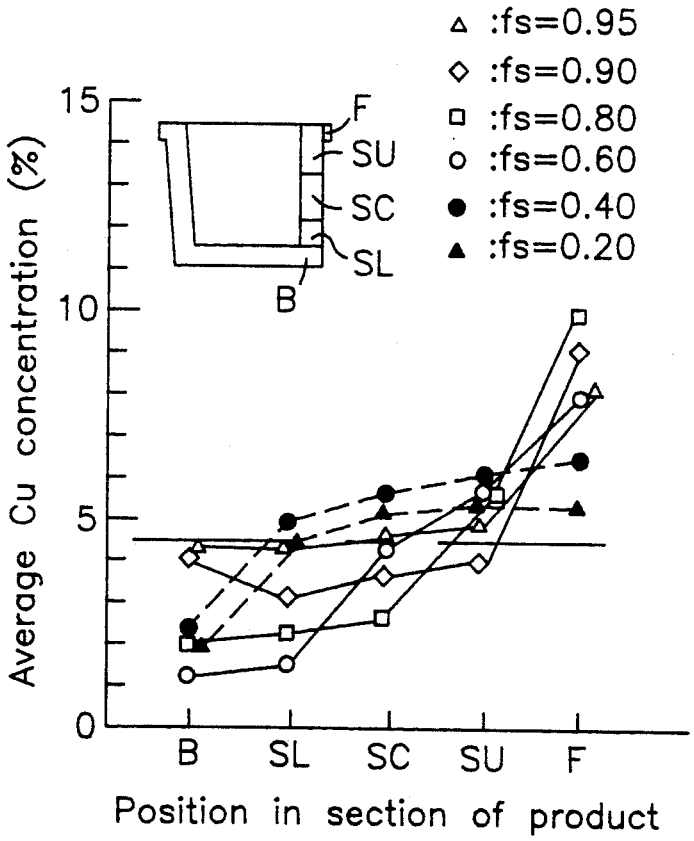
FIG. 2 a graph showing the concentration of Cu at positions in section of a cup-shaped product based on mass fraction solid as a parameter.

The measured results are shown in FIG. 2.

It is apparent from FIG. 2 that when the mass fraction solid of the starting material in the forming is 0.6 and 0.8, the difference of the Cu concentration over the section of the product is large, and that when the mass fraction solid is fairly high as 0.90–0.95, the difference in the Cu concentration over the section of the product is small but the Cu concentration in the flange portion (F) is still high. On the other hand, when the mass fraction solid is low as 0.4–0.2, the fluidity is improved to make the difference in the Cu concentration small but it is observed to deviate the Cu concentration at positions in the section of the product from the Cu concentration of the starting material (4.5%) and hence the macrosegregation is not still prevented.

The inventors have examined the above experimental results and aimed at the forging rate as a particularly significant factor among factors exerting on the behaviors of solid phase and liquid phase in the forming, and then made a high forging rate experiment using a horizontal type high speed press.

Figure 3:
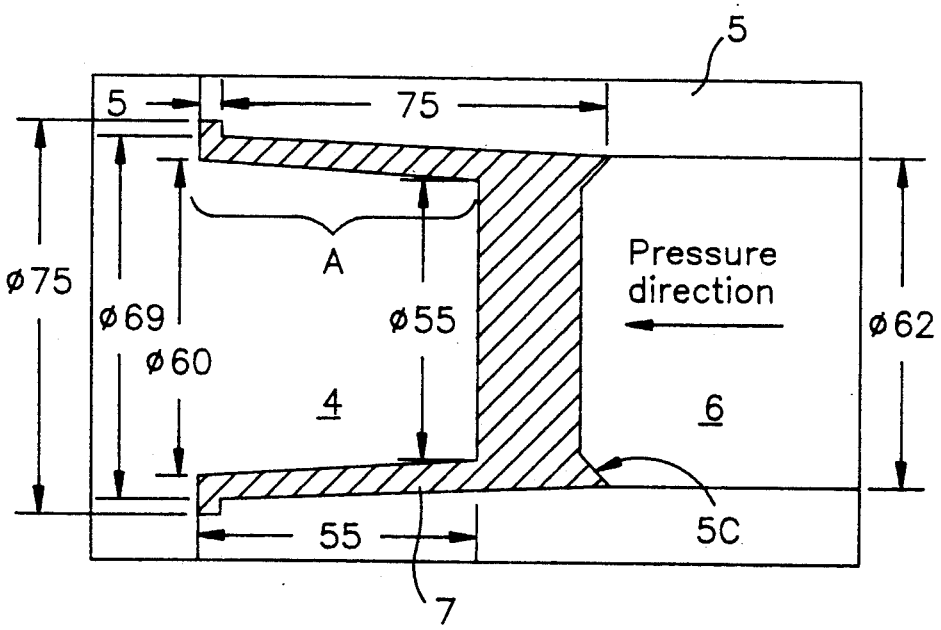
FIG. 3 is a diagrammatical view of a die assembly suitable for carrying out the invention.

The specimen used in this experiment is the same Al–4.5 wt% Cu granular structure material as in FIG. 2 and has a size of 58 mm in diameter and 50 mm in height. In FIG. 3 is shown a die assembly used in the experiment. Moreover, the die assembly is maintained at room temperature without heating. In FIG. 3, numerals 4, 5 are dies, numeral 6 a ram and numeral 7 a forged product.

Figure 4A:
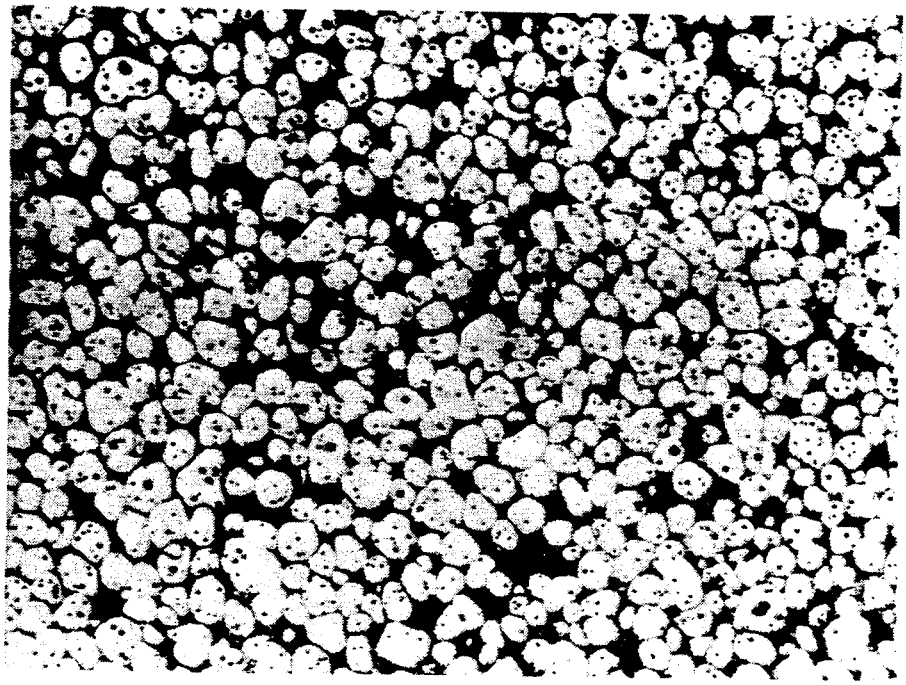
FIGS. 4*a* to *c* are microphotographs of the metal structure in the flange portion, sidewall central portion and bottom of a cup-shaped product in section.
Figure 4B:
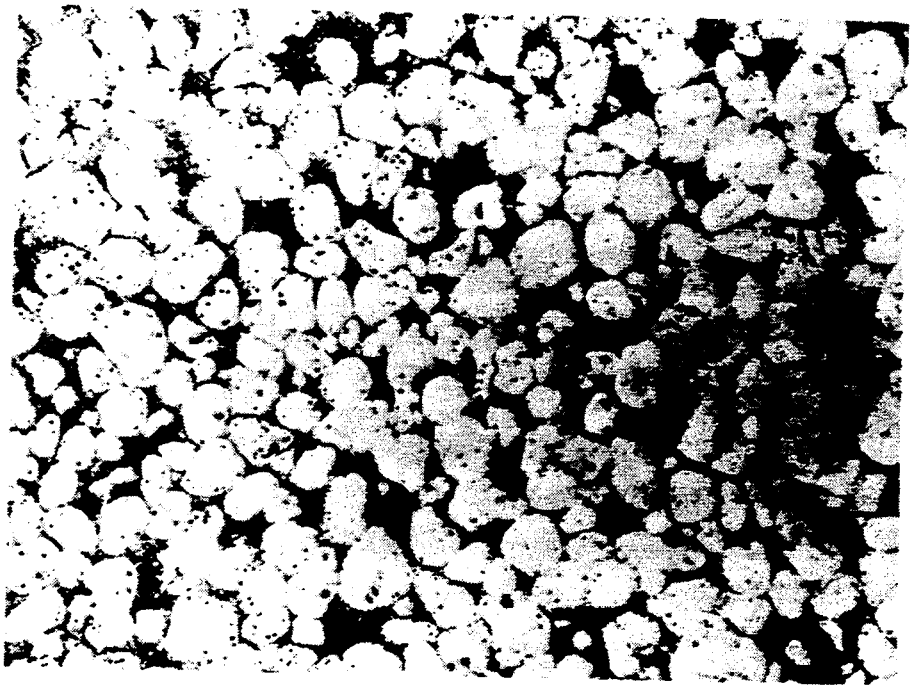
Figure 4C:
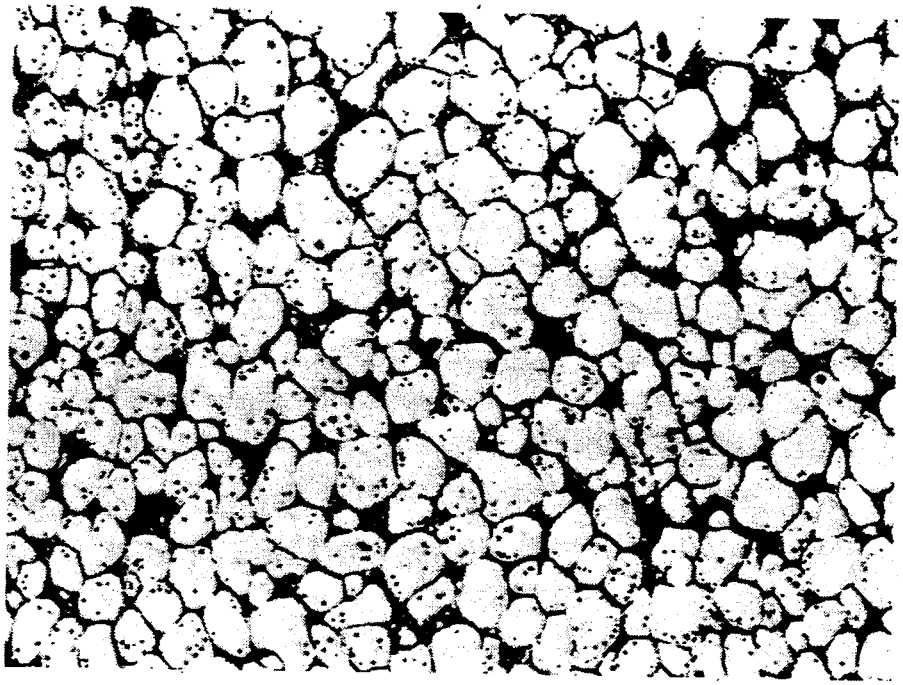

In FIG. 4*a* to 4*c* are shown microphotographs of the flange portion, sidewall central portion and bottom in the metal structure of the resulting cup-shaped product when the specimen is forged at a ram velocity of 2.5 m/sec under a condition that the mass fraction solid of the specimen at a time of the forging is 0.6, respectively.

As seen from FIG. 4, when the forging and forming are carried out under the above conditions, solid phase particles are uniformly distributed up to the top of the flange portion, so that the solid phase and the liquid phase flow uniformly.

Figure 5:
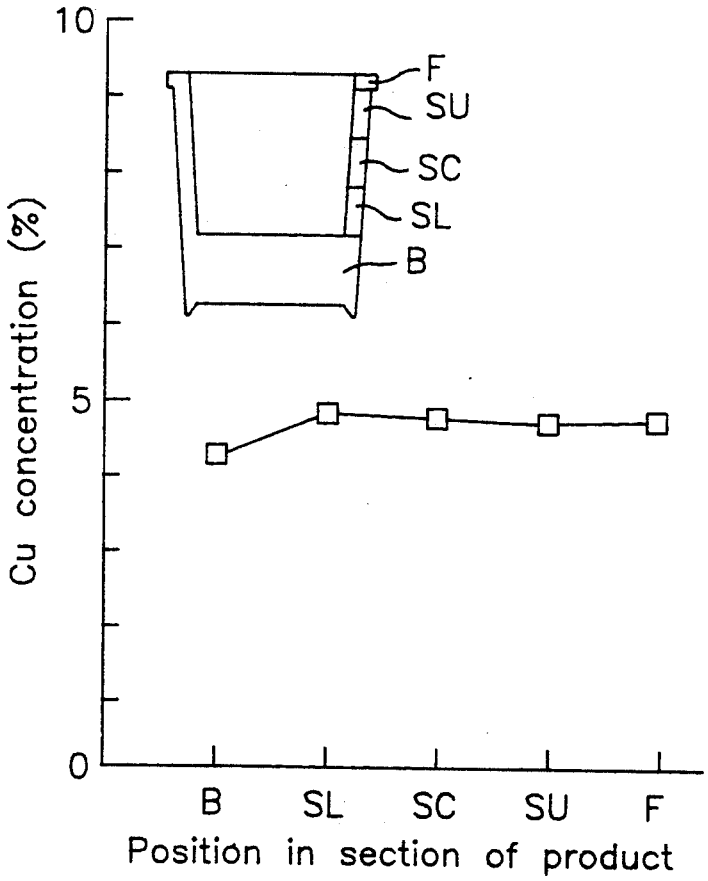
FIG. 5 is a graph showing the concentration of Cu at positions in section of the cup-shaped product.

In FIG. 5 is shown analytical values of the Cu concentration at positions in the section of the product.

As seen from FIG. 5, the difference of the Cu concentration over the section of the product is very small.

The inventors have made further experiment by varying the ram velocity and the fraction solid of the starting material. As a result, it has been confirmed that the ram velocity is sufficient to be not less than 1 m/sec for uniformly flowing the solid phase and the liquid phase.

In the forging at the solid-liquid coexistent temperature region, the rate of the starting material passing through the die assembly is a strong factor actually exerting on the behavior of solid phase and liquid phase. In this connection, the inventors have made further studies and found that when the flowing rate of the starting material in the filling region of the die assembly (the filling region is a region A in the cup-shaped die assembly of FIG. 3) is not less than 3.5 m/sec, the solid phase and the liquid phase flow uniformly. Moreover, the flowing rate $V_S$ of the starting material is defined by the following formula:

$$V_s=(A_t/A_s)\cdot V_R \quad (1)$$

wherein $A_t$ is a sectional area of the starting material, $A_S$ is a sectional area of the starting material passing through the filling region of the die assembly, and $V_R$ is a ram velocity.

As previously mentioned, in the forming of the semi-solidified metal composition at the solid-liquid coexistent temperature region, it is required that the flowing rate of the starting material passing through the filling region of the die assembly is not less than 3.5 m/sec in order to uniformly flow the solid phase and the liquid phase so as to prevent the occurrence of macrosegregation in the section of the product, because as the flowing rate of the starting material becomes high, the moving speed of solid phase rises up to an extent substantially equal to that of liquid phase.

The inventors have made various press experiments at the solid-liquid coexistent temperature region under wide working conditions and found that the similar behavior as mentioned above is caused in not only Al alloy but also Cu alloy and general-purpose metals, particularly steel having a highest temperature at the solid-liquid coexistent temperature region. Therefore, in order to prevent the separation between solid phase and liquid phase even in the forming of these alloys, the flowing rate of the starting material in the filling region of the die assembly is sufficient to be not less than 3.5 m/sec. However, if the flowing rate is too fast, there are caused ununiform leakage of the starting material from a joint face of the die assembly, large scaling of the equipment and the like, so that the upper limit of the flowing rate is desirable to be about 20 m/sec.

Moreover, the invention intends to use a die assembly for die-forging or the like having no gate for considerably raising the flowing rate. That is, the invention is not applied to a die assembly having a gate such as die cast because there is a fear of entrapping bubbles in the passing through the gate.

In the invention, when the section of the die assembly is not of a size, it is required that the flowing rate in widest sectional area in the filling region of the die assembly satisfies the above value.

According to the invention, when the mass fraction solid of the starting material at the time of starting the forging exceeds 0.8, the fluidity of the starting material lowers, and particularly in case of the high forging rate, the forming load increases and also the filling property in the die assembly and the surface quality of the forged product are degraded. On the other hand, when the mass fraction solid is less than 0.2, the temperature difference between temperature corresponding to such a low fraction solid and liquids is generally very small and hence it is difficult to control the temperature.

In the invention, therefore, the mass fraction solid of the starting material at the time of starting the forging is restricted to a range of 0.2–0.8. Moreover, when the mass fraction solid becomes lower than about 0.5 at the solid-liquid coexistent temperature region of metal, the starting material is crashed by dead weight and the handling is difficult. In this case, the starting material is heated in a vessel such as ceramic vessel or the like before the introduction into the forging machine, or it is heated in a cylindrical vessel of ceramic or the like assembled in the forging machine to directly feed into a die assembly without handling.

As the die temperature in the forming, when it is as low as about room temperature, fine cracks are caused in the surface of the forged product to degrade the surface quality, and also there is a fear of lowering the filling property of the starting material in the die assembly. Therefore, it is desirable that the die assembly is heated at a temperature of not lower than 50° C., preferably not lower than 100° C.

In the semi-solidified metal composition filled in the die assembly are existent bubbles entrapped in the agitation at the solid-liquid coexistent temperature region and voids produced by shrinkage at the solidification step. Such bubbles and voids bring about the considerable degradation of mechanical properties of the product, particularly tensile strength.

According to the inventors' studies, it has been found that a pressure of at least 6 kg/mm$^2$ is required for removing the bubbles and voids to a harmless extent. Therefore, in the invention, the semi-solidified metal composition as a starting material filled in the die assembly is held under a pressure of not less than 6 kg/mm$^2$ until the starting material is completely solidified.

In the forming such as die-forging, the starting material is required to have a granular structure for utilizing the good fluidity at the solid-liquid coexistent temperature region. Such a granular structure may be realized by a method wherein the starting material is agitated by mechanical or electromagnetic rotation at the solid-liquid coexistent temperature region, or by a method of adding a crystal grain dividing agent such as Ti or the like, or by a low-temperature forging. Furthermore, the granular structure can be formed by hot working.

The inventors have confirmed from die forming experiments that in the semi-solidified metal composition having a dendrite structure as a typical granular structure, the solid phase is coarsened at the solid-liquid coexistent temperature region to make the flowing of solid and liquid phases very ununiform.

The invention has mainly been described on the case that the starting material having the granular structure after the solidification is again heated to the solid-liquid coexistent temperature region as a semi-solidified metal composition having the granular structure, but is not intended as limitation thereof. That is, the semi-solidified metal composition of the solid-liquid coexistent state without solidification can be used as it is. In the latter case, the metal composition is fed into the forming machine and treated under the given conditions according to the invention.

The following examples are given in illustration of the invention and are not intended as limitations thereof.

EXAMPLE 1

After Al–4.5 wt% Cu alloy was mechanically agitated at a solid-liquid coexistent temperature region in an apparatus for continuously producing a semi-solidified metal composition, it was cooled to room temperature and solidified to form an ingot having a granular structure. Then, a starting material of 58 mm in diameter and 50 mm in height was cut out from the ingot and heated to a temperature (632° C.) corresponding to a mass fraction solid at the solid-liquid coexistent temperature region of 0.6 under a high frequency and filled in a cup-shaped die assembly (FIG. 3) preheated at 120° C. and formed by rapidly operating a ram set to such a speed that a minimum value of flowing rate of the starting material in a filling region of the die assembly was 4.5 m/sec.

Figure 6A:
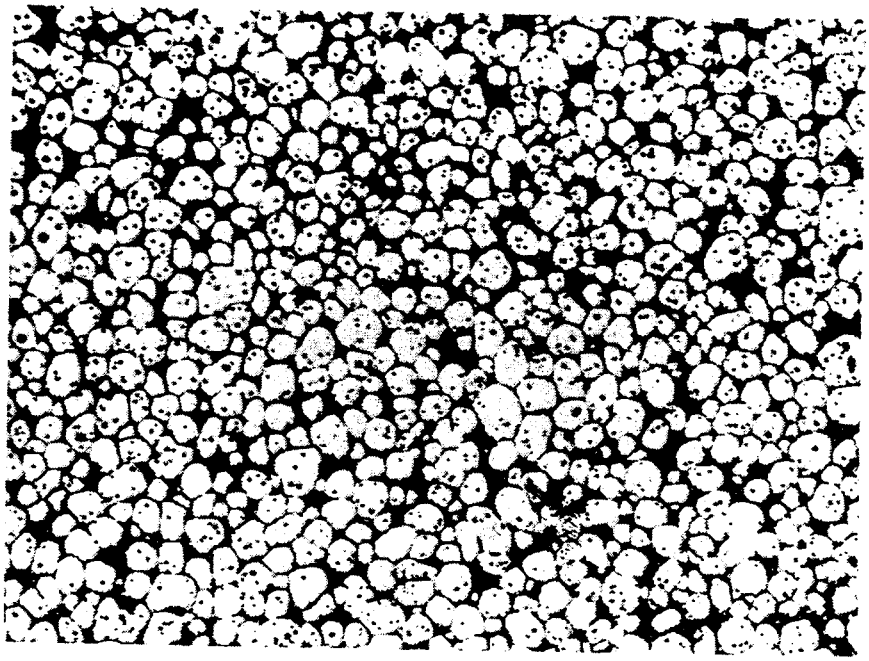
FIGS. 6*a* to *c* are microphotographs of the metal structure in the flange portion, sidewall central portion and bottom of another cup-shaped product in section.
Figure 6B:
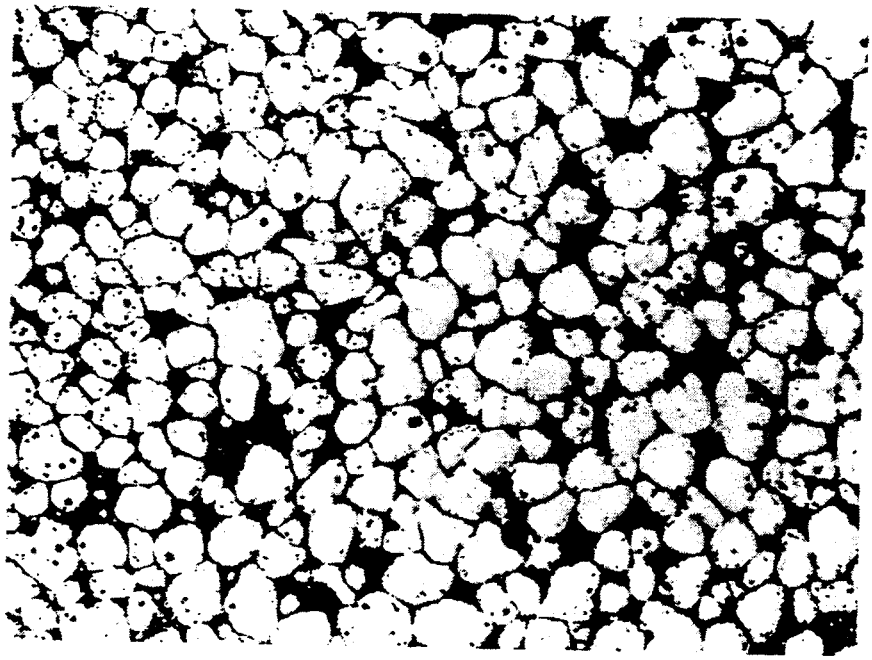
Figure 6C:
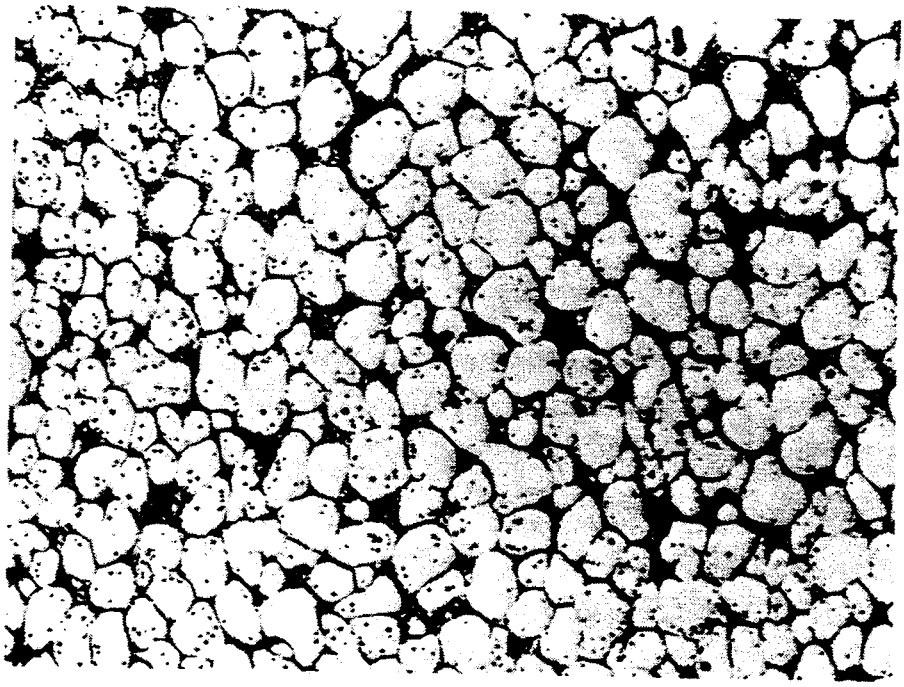

In FIG. 6 are shown microphotographs of flange portion, sidewall central portion and bottom portion in section of the resulting product after the forming, from which it is apparent that the solid phase and the liquid phase are substantially uniformly distributed at any positions in the section of the product.

Figure 7:
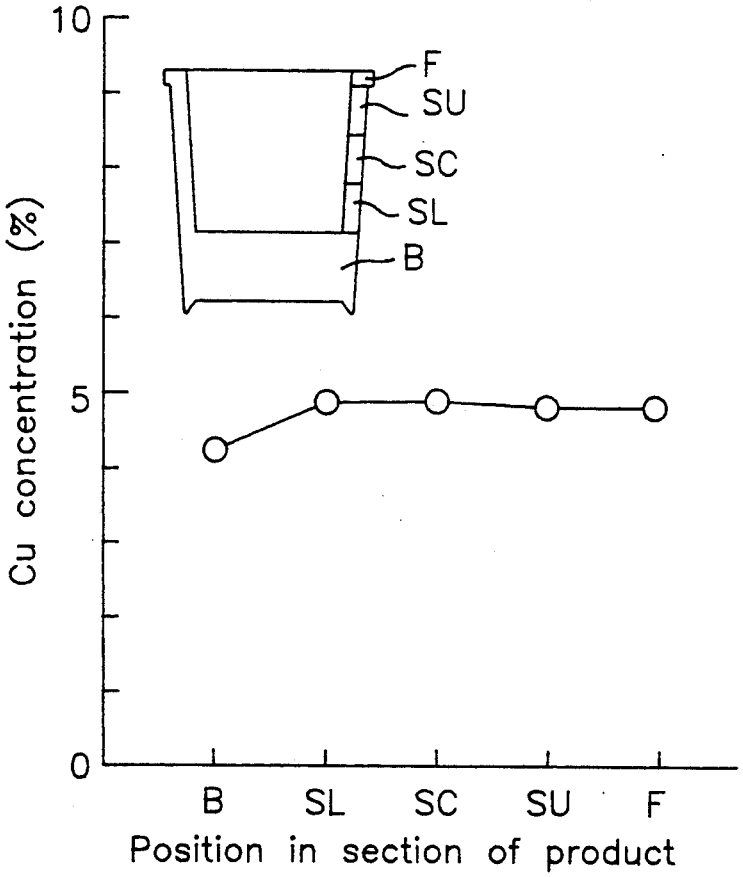
FIG. 7 is a graph showing the concentration of Cu at positions in section of the cup-shaped product.

In FIG. 7 are shown chemical analytical values of Cu concentration at any positions in the section of the product, from which it is apparent that the deviation of the Cu concentration at any positions from that of the starting material (4.5 wt%) is small and the qualities of the surface and inside of the product are good.

EXAMPLE 2

The starting material of 58 mm in diameter and 50 mm in height produced by the same method as in Example 1 was heated to a temperature (619° C.) corresponding to the mass fraction solid at solid-liquid coexistent temperature region of 0.75 under a high frequency, fed into a cup-shaped die assembly (FIG. 3) preheated at 120° C. and then formed by rapidly operating a ram set to such a speed that a minimum value of flowing rate of the starting material in the filling region of the die assembly was 7 m/sec.

Figure 8A:
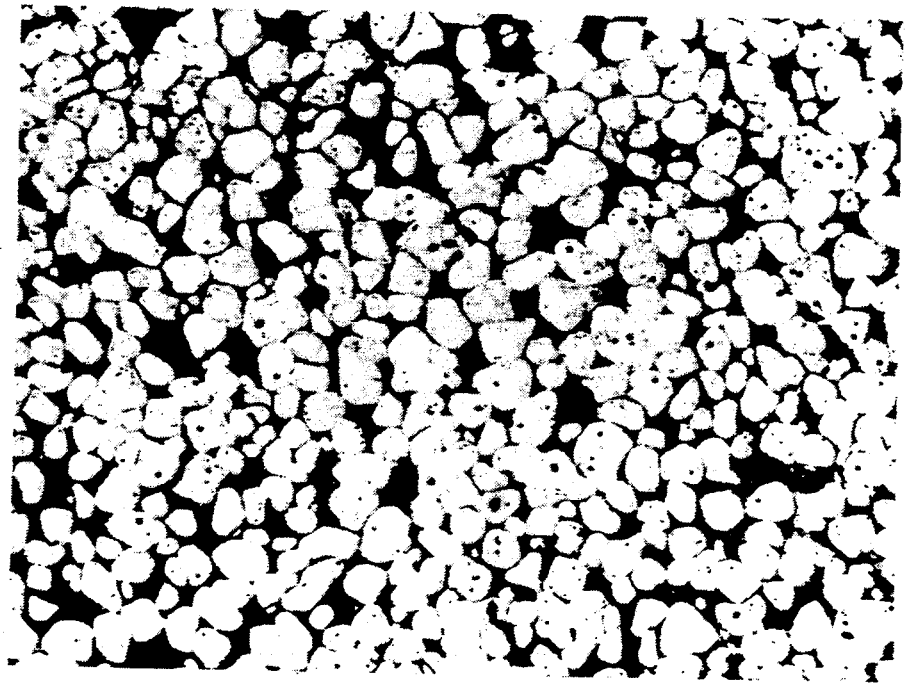
FIGS. 8*a* to *c* are microphotographs of the metal structure in the flange port sidewall central portion and bottom of the other cup-shaped product in section.
Figure 8B:
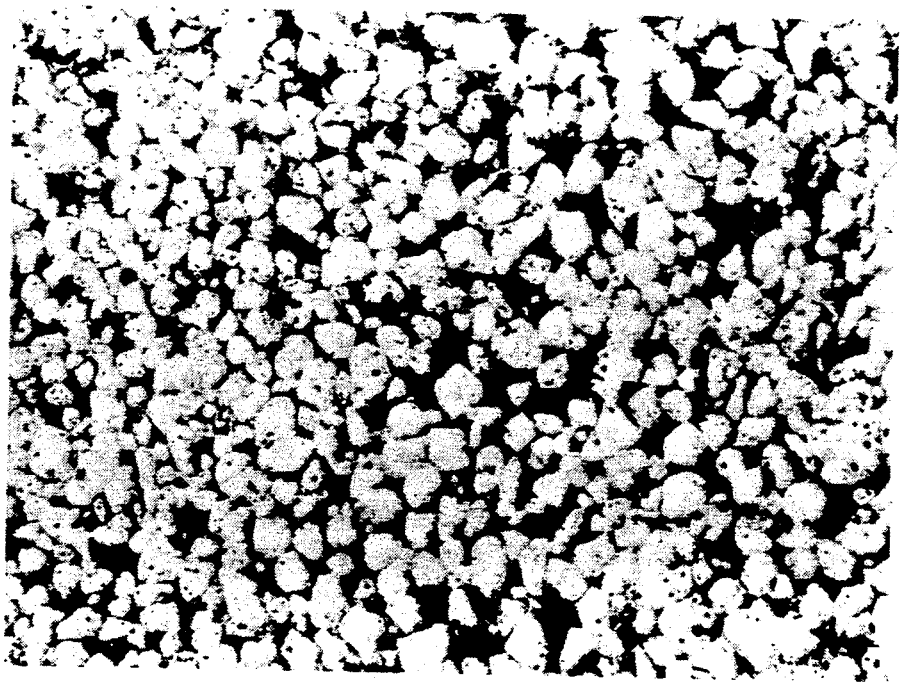
Figure 8C:
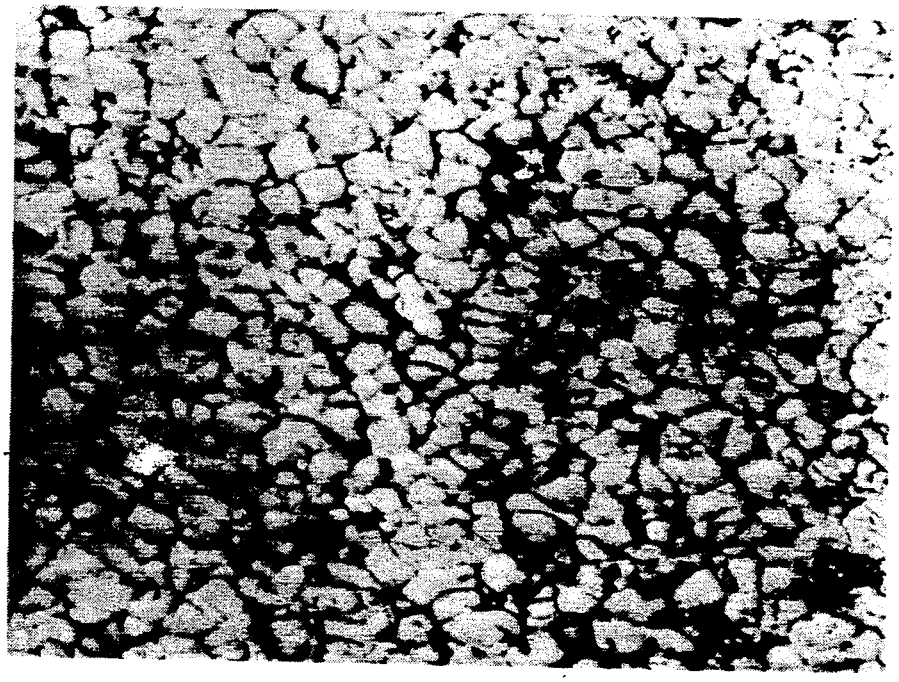

In FIG. 8 are shown microphotographs of flange portion, sidewall central portion and bottom portion in the section of the formed product, from which it is apparent that solid phase particles are substantially uniformly distributed up to the top of the flange portion and hence the solid phase and the liquid phase flow substantially uniformly even in case of the high fraction solid.

COMPARATIVE EXAMPLE 1

The starting material of 58 mm in diameter and 50 mm in height produced by the same method as in Example 1 was heated to a temperature (632° C.) corresponding to the mass fraction solid at solid-liquid coexistent temperature region of 0.6 under a high frequency, fed into a cup-shaped die assembly (FIG. 3) preheated at 250° C. and then formed by rapidly operating a ram set to such a speed that a minimum value of flowing rate of the starting material in the filling region of the die assembly was 0.9 m/sec.

In the section of the product after the forming, the deviation of the liquid phase was particularly observed in the flange portion and hence the product having uniformly distributed solid and liquid phases at any positions in its section was not obtained.

EXAMPLE 3

After 0.6 wt% C carbon steel was mechanically agitated at a solid-liquid coexistent temperature region in an apparatus for continuously producing a semi-solidified metal composition, it was cooled to room temperature and solidified to form an ingot having a granular structure. Then, a starting material of 58 mm in diameter and 50 mm in height was cut out from the ingot and heated to a temperature (1458° C.) corresponding to a mass fraction solid at the solid-liquid coexistent temperature region of 0.6 under a high frequency and filled in a cup-shaped die assembly (FIG. 3) preheated at 250° C. and formed by rapidly operating a ram set to such a speed that a minimum value of flowing rate of the starting material in a filling region of the die assembly was 5.4 m/sec.

Figure 9A:
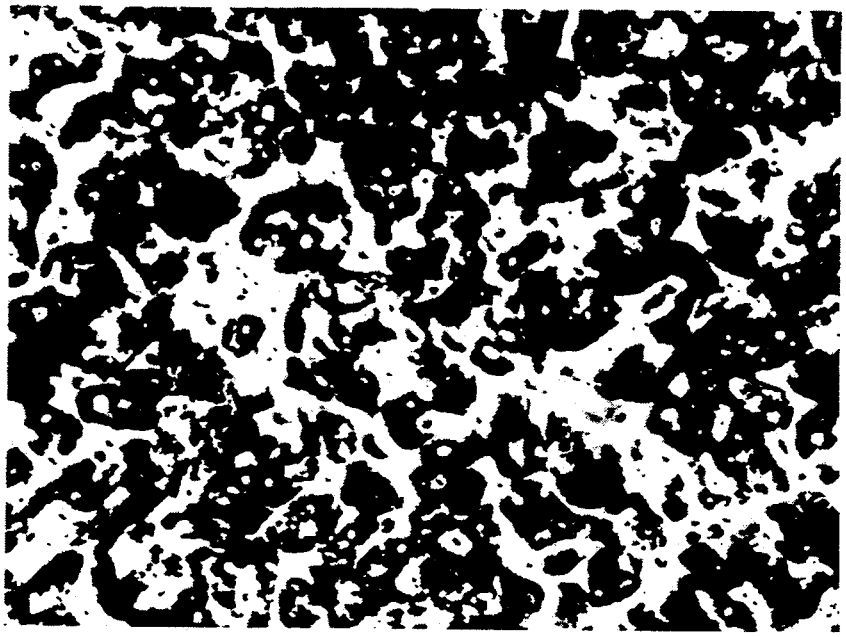
FIGS. 9*a* to *c* are microphotographs of the metal structure in the flange portion, sidewall central portion and bottom of a further cup-shaped product in section.
Figure 9B:
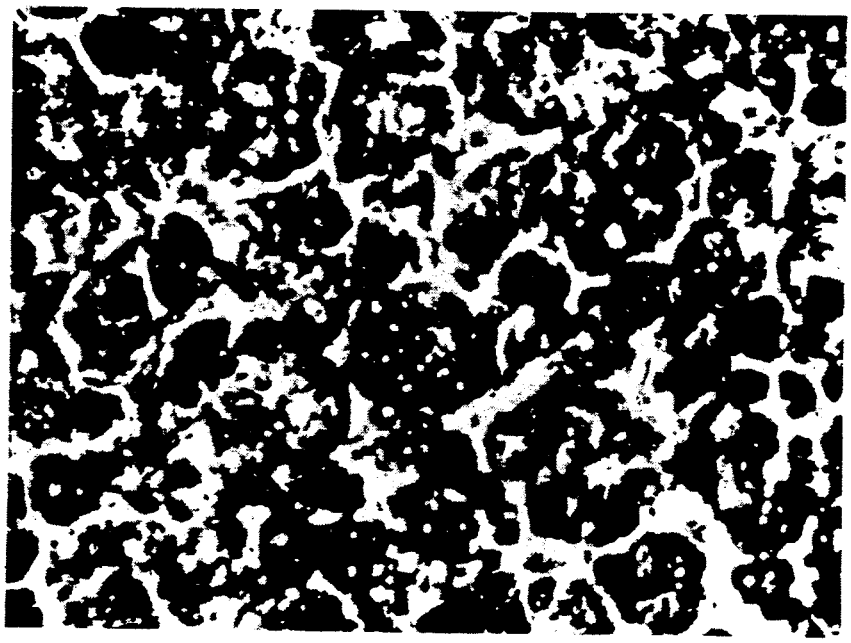
Figure 9C:
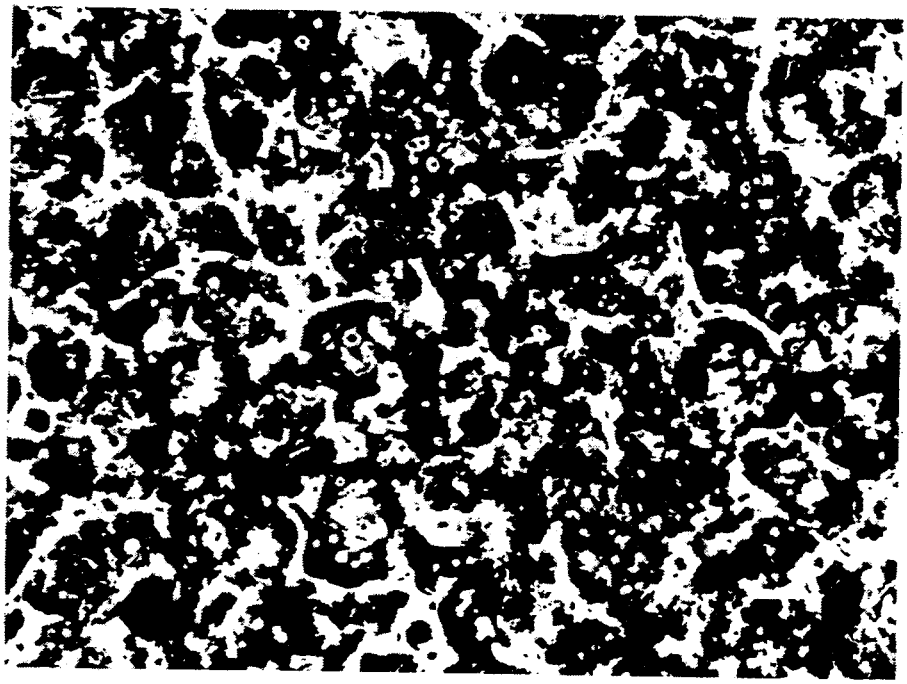

In FIG. 9 are shown microphotographs of flange portion, sidewall central portion and bottom portion in section of the resulting product after the forming, from which it is apparent that the solid phase and the liquid phase are substantially uniformly distributed at any positions in the section of the product.

Figure 10:
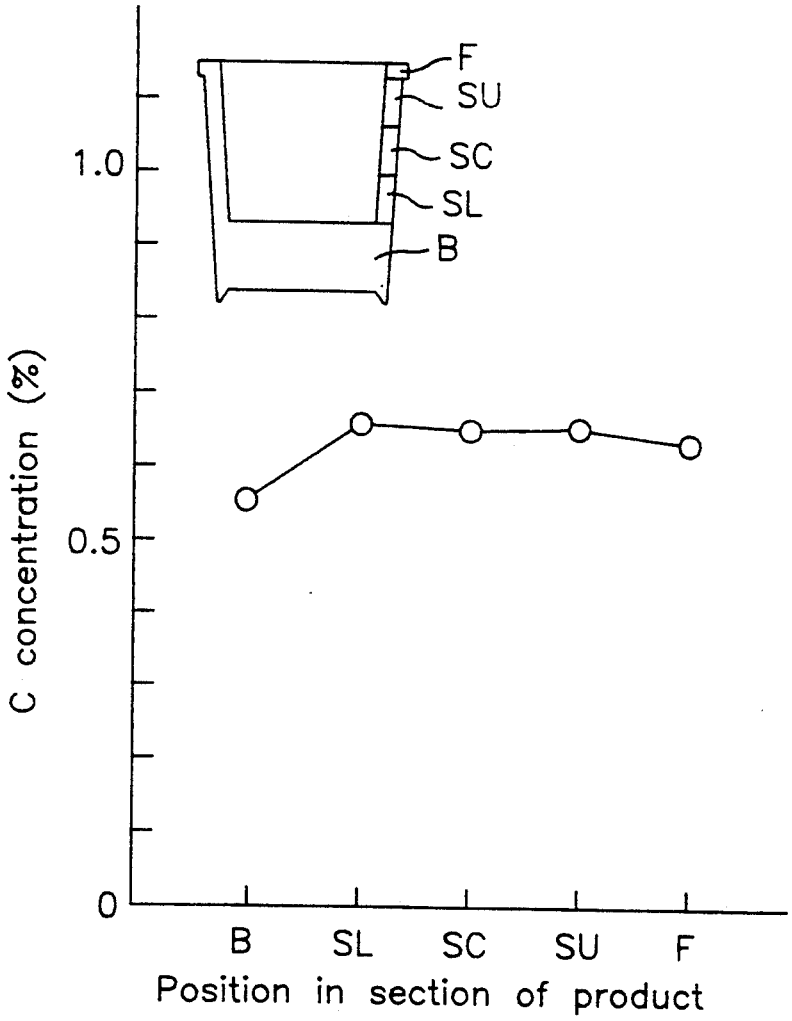
FIG. 10 is a graph showing the concentration of C at positions in section of the cup-shaped product.

In FIG. 10 are shown chemical analytical values of C concentration at any positions in the section of the product, from which it is apparent that the deviation of the C concentration at any positions from that of the starting material (0.6 wt%) is small and the qualities of the surface and inside of the product are good.

COMPARATIVE EXAMPLE 2

The starting material of 58 mm in diameter and 50 mm in height produced by the same method as in Example 3 was heated to a temperature (1458° C.) corresponding to the mass fraction solid at solid-liquid coexistent temperature region of 0.6 under a high frequency, fed into a cup-shaped die assembly (FIG. 3) preheated at 350° C. and then formed by rapidly operating a ram set to such a speed that a minimum value of flowing rate of the starting material in the filling region of the die assembly was 1.1 m/sec.

In the section of the product after the forming, the deviation of the liquid phase was particularly observed in the flange portion and hence the product having uniformly distributed solid and liquid phases at any positions in its section was not obtained.

As mentioned above, according to the invention, the starting material is formed under conditions satisfying the mass fraction solid and flowing rate within particular ranges and held under a given pressure, whereby the solid phase and the liquid phase are uniformly flowed in the forming at solid-liquid coexistent temperature region to obtain a formed product having good qualities of its surface and inside without causing macrosegregation in the section of the product. Therefore, it is possible to conduct the forming while utilizing the high flowing property of the starting material at the solid-liquid coexistent temperature region and the small forming pressure.

What is claimed is:

1. In a method of forming a semi-solidified metal composition by die forging a semi-solidified metal composition as a starting material at a solid-liquid coexistent state under conditions that said starting material is filled in a filling region of a die assembly at a mass fraction solid of 0.2–0.8 at a time of starting said die forging and then held under a pressure of not less than 6 kg/mm$^2$ until said starting material is completely solidified after the filling in said die assembly, an improvement wherein said starting material is flowed in said filling region at a flowing rate of not less than 3.5 m/sec during the filling.

2. The method according to claim 1, wherein said flowing rate is not more than 20 m/sec.

3. The method according to claim 1, wherein said die assembly is preliminarily heated to not lower than 50° C.

4. A method of forming a semi-solidified metal composition by die forging a semi-solidified metal composition as a starting material at a solid-liquid coexistent state, said method comprising the steps of:

a) preparing a semi-solidified metal composition at a solid-liquid coexistent temperature region;

b) cooling and solidifying said semi-solidified metal composition to form an ingot having a granular structure;

c) forming a starting material from said ingot;

d) heating said starting material to a temperature corresponding to a mass fraction solid at the solid-liquid coexistent temperature region of 0.2–0.8;

e) filling said heated starting material in a die assembly having a filling region; and f) die forging said heated starting material by operating a ram at a speed sufficient to create a starting material flowing rate in the filling region of said die of at least 3.5 m/sec.

5. The method according to claim 4, wherein said flowing rate is not more than 20 m/sec.

6. The method according to claim 4, wherein said die assembly is preliminarily heated to a temperature not lower than 50° C.

* * * * *